US006796676B2

(12) United States Patent
Severtson et al.

(10) Patent No.: US 6,796,676 B2
(45) Date of Patent: Sep. 28, 2004

(54) LIGHTING FIXTURE END CAP

(75) Inventors: Michael C. Severtson, Post Falls, ID (US); Wilton L. Fowler, Veradale, WA (US); Raymond A. Brown, Spokane, WA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/317,209

(22) Filed: Dec. 12, 2002

(65) Prior Publication Data

US 2004/0114361 A1 Jun. 17, 2004

(51) Int. Cl.[7] ..... F21S 8/06
(52) U.S. Cl. ..... 362/219; 362/225
(58) Field of Search ..... 362/217, 219, 362/225, 260, 220, 147, 404

(56) References Cited

U.S. PATENT DOCUMENTS

| | | | | |
|---|---|---|---|---|
| 2,531,232 A | | 11/1950 | Naysmith | |
| 3,299,264 A | | 1/1967 | Lipscomb | |
| 3,599,911 A | | 8/1971 | Monte | |
| 4,726,781 A | * | 2/1988 | Bernhart et al. | 362/219 |
| 4,866,583 A | | 9/1989 | Targetti | |
| 5,658,066 A | | 8/1997 | Hirsch | |
| 6,007,217 A | | 12/1999 | Ferrier | |
| 6,231,209 B1 | | 5/2001 | Leibig et al. | |
| 6,435,697 B1 | * | 8/2002 | Simmons et al. | 362/219 |
| 6,530,674 B2 | * | 3/2003 | Grierson et al. | 362/219 |
| 2002/0001191 A1 | | 1/2002 | Grierson et al. | |
| 2002/0080606 A1 | | 6/2002 | Yaphe et al. | |

* cited by examiner

*Primary Examiner*—Y My Quach Lee
(74) *Attorney, Agent, or Firm*—Mark S. Bicks; Alfred N. Goodman

(57) ABSTRACT

An end cap for a lighting fixture including an end wall that has a periphery, an outer surface, and an inner surface opposite the outer surface that is adapted to engage the lighting fixture. A tongue element extends from the outer surface in a first direction along the periphery of the end wall. A groove element is disposed along the periphery of the end wall and is open at the outer surface of the end wall. A suspension element extends from the inner surface of the periphery of the end wall. The suspension element extends in a second direction opposite the first direction of the tongue element. The tongue and groove elements of the end cap are adapted to engage tongue and groove elements of another substantially identical end cap of another lighting fixture.

26 Claims, 7 Drawing Sheets

LIGHTING FIXTURE END CAP

FIELD OF THE INVENTION

The present invention relates to end caps for lighting fixtures which facilitate mounting of the lighting fixtures in an end-to-end orientation and substantially prevents light leakage between the fixtures. More specifically, the end caps are of identical design and include integral engaging elements for connecting the ends of the lighting fixtures and preventing light leakage.

BACKGROUND OF THE INVENTION

Conventional lighting fixtures typically require a separate member to connect more than one lighting fixture in an end-to-end arrangement. For example, often a separate bridge member or a separate bracket is required to connect conventional lighting fixtures end-to-end. Also, mating end caps of different construction may have to be employed on each lighting flange to be connected. This increases the number of parts required to mount lighting fixtures end-to-end and thus increases manufacturing costs and time required for mounting or installing the fixtures. Additionally, the conventional mechanisms for mounting lighting fixtures end-to-end typically allow light to leak at the connection point, thereby decreasing the aesthetics and effectiveness of the lighting fixtures.

Moreover, conventional lighting fixtures have suspension mechanisms for suspending the fixtures from a support, such as a ceiling. Commonly, these suspension mechanisms are difficult to assemble, due to multiple parts and multiple assembly steps, thereby decreasing the efficiency of the installation process.

Examples of conventional lighting fixtures with end caps include U.S. Pat. No. 6,007,217 to Ferrier; U.S. Pat. No. 5,658,066 to Hirsch; U.S. Pat. No. 4,866,583 to Targetti; U.S. Pat. No. 3,599,911 to Monte; U.S. Pat. No. 3,299,264 to Lipscomb; and U.S. Pat. No. 2,531,232 to Naysmith, the subject matter of each being hereby incorporated herein by reference. Also, U.S. patent application Publication Nos. 2002/0080606 to Yaphe et al. and 2002/0001191 to Grierson et al. also provide examples of conventional lighting fixtures with end caps and are also hereby incorporated herein by reference.

SUMMARY OF THE INVENTION

Accordingly, an object of the present invention is to provide end caps for lighting fixtures that facilitate mounting the lighting fixtures end-to-end.

Another object of the present invention is to provide end caps for lighting fixtures that are substantially identical in design and formed as unitary, one piece members, thereby facilitating manufacturing and installing of the end caps and decreasing costs.

Yet another object of the present invention is to provide end caps for lighting fixtures that substantially prevent light leakage between lighting fixtures when mounted end-to-end.

Still another object of the present invention is provide end caps for lighting fixtures that facilitate mounting of a relatively simple suspension mechanism for suspending the lighting fixtures from a support.

The foregoing objects are basically attained by an end cap for a lighting fixture including an end wall that has a periphery, an outer surface, and an inner surface opposite the outer surface that is adapted to engage the lighting fixture.

A tongue element extends from the outer surface in a first direction along the periphery of the end wall. A groove element is disposed along the periphery of the end wall and is open at the outer surface of the end wall. A suspension element extends from the inner surface of the periphery of the end wall. The suspension element extends in a second direction opposite the first direction of the tongue element.

The foregoing objects are also attained by an end cap for a lighting fixture including an end wall that has a periphery, an outer surface, an inner surface opposite the outer surface that is adapted to engage the lighting fixture, and an opening at the periphery. First and second engagement elements extend from the outer surface along the periphery of the end wall. A suspension element extends from the inner surface at the periphery of the end wall. The suspension element includes a tab that extends substantially perpendicularly from the end wall. The tab has a slot contiguous with the opening in the end wall. Each of the slot of the tab and the opening of the end wall, respectively, are adapted to receive a support member for suspending the light fixture.

The foregoing objects are also attained by a lighting fixture assembly including first and second lighting fixtures with each of the lighting fixtures, respectively, having an end. First and second substantially identical end caps are coupled to the ends of each of the first and second lighting fixtures, respectively. Each of the first and second end caps have an end wall with first and second opposite surfaces. Tongue and groove elements extend from the first surface. The tongue element of the first end cap is received in the groove element of the second end cap. The tongue element of the second end cap is received in the groove element of the first end cap. The end walls of each of the first and second end caps abut one another.

The foregoing objects are also attained by a lighting fixture assembly including a lighting fixture with opposing ends. An end wall is coupled to one of the ends of the lighting fixture. The end wall has a periphery and opposite outer and inner surfaces. A tongue element extends from the periphery of the end wall. A groove element is disposed along the periphery of the end wall. The groove element is open at the outer surface of the end wall. An engaging member extends from the periphery of the end wall at the inner surface. The engaging member is adapted to form an interference fit with the end of the lighting fixture.

Other objects, advantages and salient features of the invention will become apparent from the following detailed description, which, taken in conjunction with the annexed drawings, discloses preferred embodiments of the present invention.

BRIEF DESCRIPTION OF THE DRAWINGS

Referring now to the annexed drawings which form a part of this disclosure.

DETAILED DESCRIPTION OF THE PREFERRED EMBODIMENTS

Embodiment of FIGS. 1–7

Figure 1:
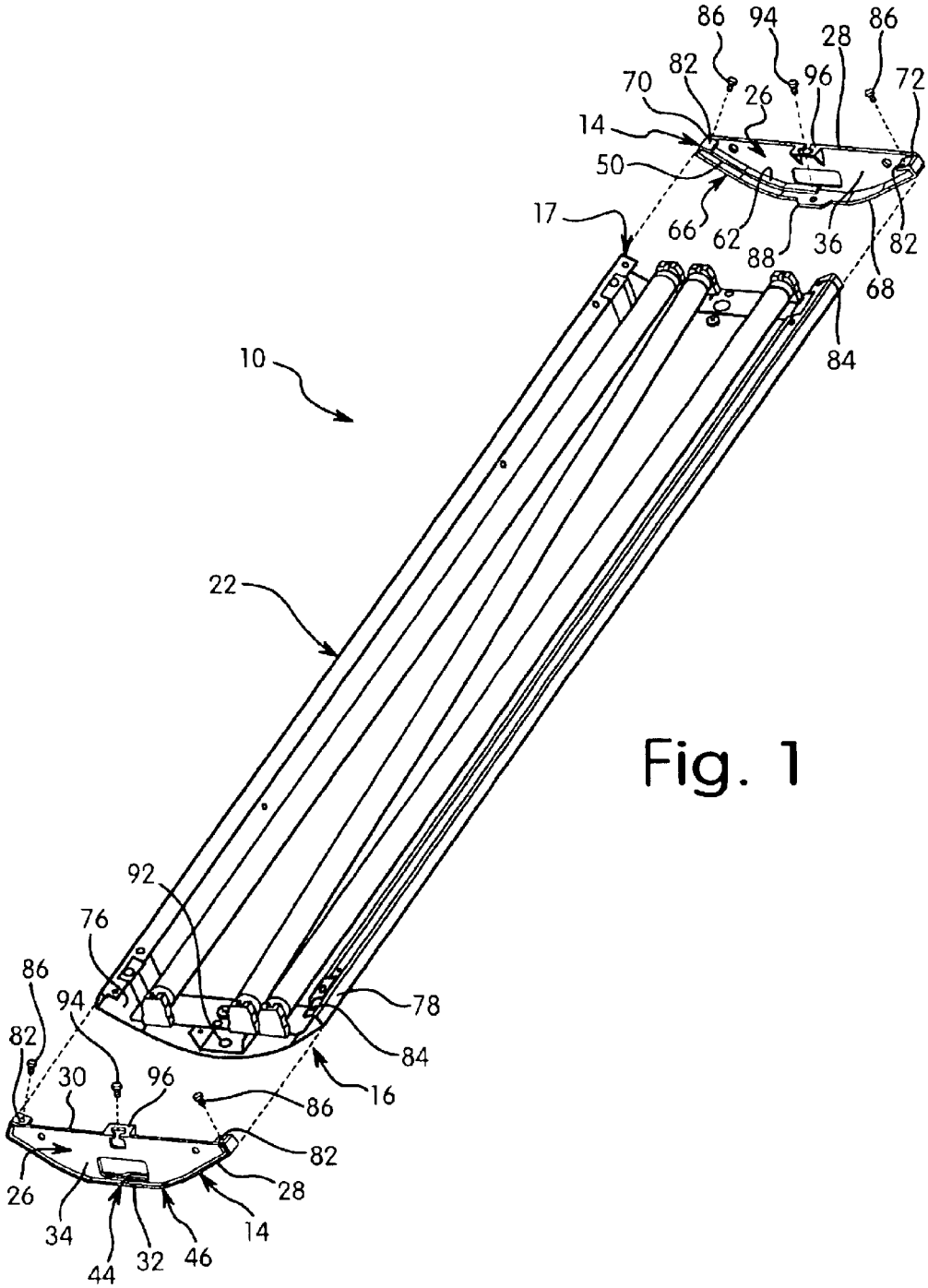
FIG. 1 is an exploded perspective view of a lighting fixture and two end caps in accordance with a first embodiment of the present invention, showing the end caps being attached to the ends of the lighting fixture.
Figure 2:
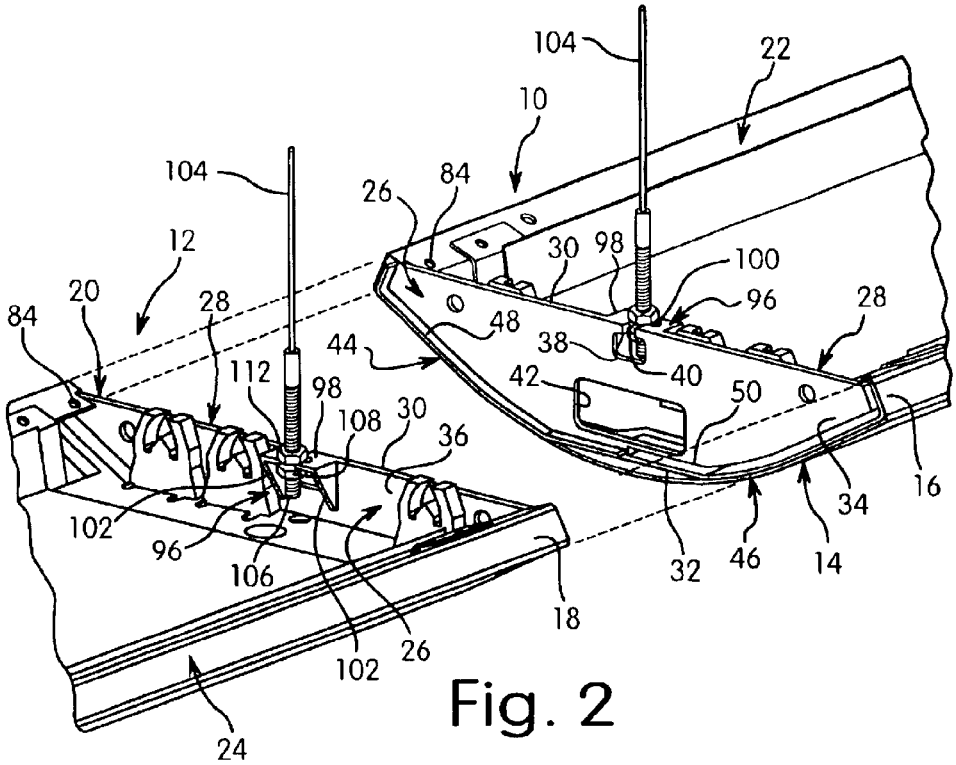
FIG. 2 is a perspective view of first and second lighting fixtures in accordance with the first embodiment of the present invention, showing the lighting fixtures with respective end caps and showing the lighting fixtures being coupled end-to-end.

Referring to FIGS. 1–7, a lighting fixture 10 in accordance with a first embodiment of the present invention includes end caps 14 at opposing ends 16 and 17 of fixture 10. End caps 14 allow connection of lighting fixture 10 to another similar lighting fixture 12 in an end-to-end arrangement, as seen in FIG. 2. In particular, end cap 14 at first end 16 of fixture 10 engages an end cap 20 of fixture 12 for an end-to-end connection of the two fixtures. End cap 14 of fixture 10 and end cap 20 of fixture 12 are substantially identical, thereby reducing manufacturing costs and simplifying connection of the two fixtures 10 and 12. Also, the configuration of end caps 14 and 20 substantially prevents leakage of light at the connection point of fixtures 10 and 12, and facilitates assembly of a suspension mechanism for suspending fixtures 10 and 12 from a support, such as a ceiling (not shown).

End caps 14 and 20 engage the ends 16 and 17 of housing 22 and ends 18 (only one end shown) of housing 24 of lighting fixtures 10 and 12, respectively. End caps 14 and 20 are preferably made of a metal material but can be formed of plastic if shielded from the heat of the lamp and ballastry of the fixtures. Also, each end cap 14 and 20 are preferably formed as unitary one-piece members. End caps 14 and 20 are substantially identical. Therefore only end cap 14 will be described and the description of end cap 14 applies to end cap 20. Also, end caps 14 engage both ends 16 and 17 of lighting fixture 10 in the same manner and thus only engagement with first end 16 will be described. End cap 14 includes an end wall 26 having a generally semi-circular shape. However, end wall 26 can have any desired shape, such as any polygonal shape or circular shape. A periphery 28 of end wall 26 defines the outer border of end wall 26 and preferably includes an upper edge 30 that is substantially straight and a lower edge 32 that is substantially curved. However, as with end wall 26, periphery 28 can be any desired shape. A first or outer surface 34 of end wall 26 faces outwardly away from lighting fixture housing 22, as seen in FIG. 2. A second or inner surface 36 is opposite outer surface 34 and faces toward light fixture housing 22.

A first opening 38 is disposed in end wall 26 near periphery 28 at upper edge 30 so that one end 40 of opening 38 is open at edge 30, thereby allowing access to opening 38. First opening 38 is preferably centered along upper edge 30. A second opening 42 is spaced from opening 38 and disposed near lower edge 32. Second opening 42 is substantially larger than first opening 38 and provides access to a ballast compartment, as seen in FIG. 1, of lighting fixture 10, and provides an opening to run electrical wiring from fixture to fixture.

Engagement elements 44 and 46 extend from outer surface 34 of end wall 26 at periphery 28. Preferably, engagement elements 44 and 46 are tongue and groove elements 48 and 50, respectively, extending along end wall periphery 28 at curved edge 32. Although it is preferable that engagement elements 44 and 46 are tongue and groove elements, any type of known engagement mechanism can be employed, such as, snapping or latching elements, fastener elements, or adhesive elements.

Figure 6:
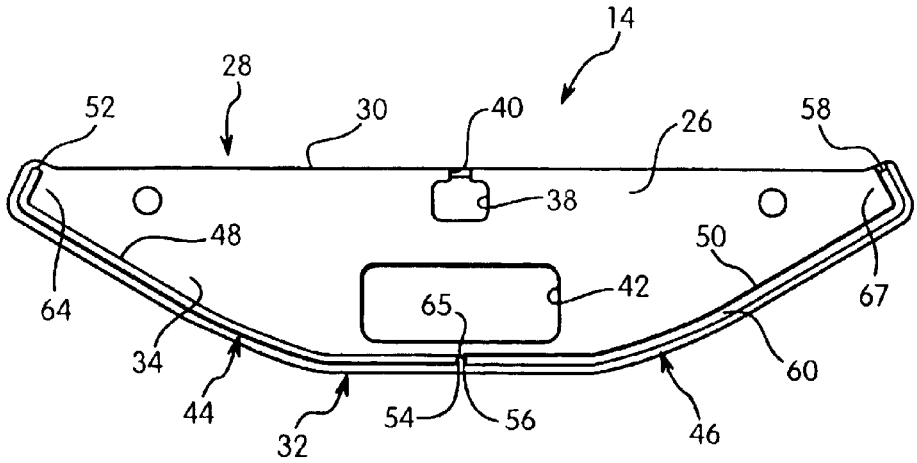
FIG. 6 is a side elevational view of the end cap illustrated in FIG. 1.

As best seen in FIG. 6, tongue element 48 is a continuous element having first and second ends 52 and 54 and extends along approximately a first half of periphery curved edge 32. Tongue element 48 extends outwardly from end wall outer surface 34 such that tongue element 48 is generally perpendicular to end wall 26 in cross section. Similarly, groove element 50 is a continuous element having first and second ends 56 and 58 and extends along approximately a second half of periphery curved edge 32. Although tongue and groove elements 48 and 50 are each preferably continuous, they can be discontinuous or have breaks therein, thereby defining multiple tongue and groove elements, respectively.

Tongue and groove elements 48 and 50 are disposed along curved edge 32 of end wall 26 in an end-to-end arrangement. As seen in FIG. 6, the first end 52 of tongue element 48 meets substantially straight edge 30 at one side 64 of end wall 26 and the second end 54 terminates at approximately the mid-point 65 of curved edge 32. Groove element 50 follows tongue element 48 so that groove element first end 56 is adjacent tongue element second end 54 so that tongue and groove elements 48 and 50 meet at mid-point 65 of curved edge 32. Groove element second end 58 meets straight edge 30 at a second side 67 opposite first side 64 of end wall 26. Although it is preferable that the ends 54 and 56 of tongue and groove elements 48 and 50 are adjacent or only slightly spaced from one another, they can alternatively be separated with a significant amount of space therebetween.

Figure 7:
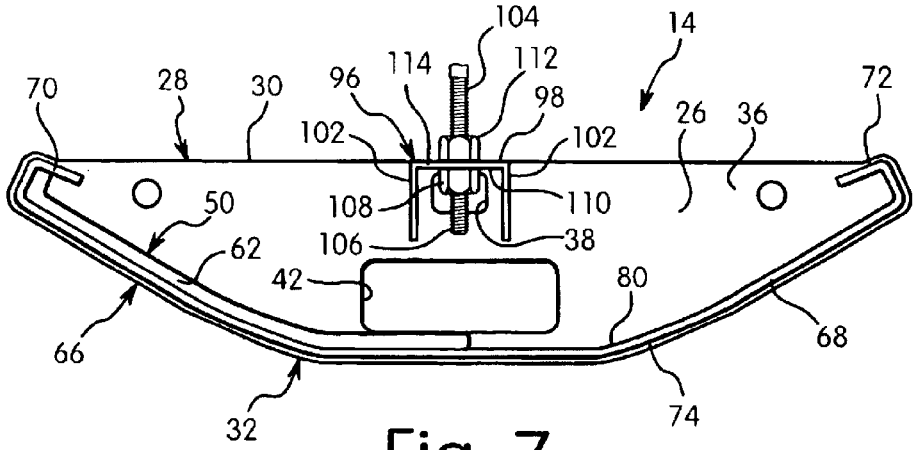
FIG. 7 is a side elevational view of the end cap illustrated in FIG. 1, showing a suspension mechanism coupled thereto.

Groove element 50 defines an access opening 60 that opens at the outer surface 34 of end wall 26, as seen in FIG. 6. Groove element 50 includes a main body 62 that extends away from the inner surface 36 of end wall 26, as best seen in FIGS. 1 and 7, in a generally perpendicular orientation with respect to end wall 26 in cross section. Groove element 50 is shaped and sized to accommodate tongue element 48 of another end cap via access opening 60. Likewise, tongue element 48 is shaped and sized to fit within groove 50 of another end cap through opening 60. For example, groove element 50 of end cap 14 of lighting fixture 10 is adapted to receive tongue element 48 of end cap 20 of lighting fixture 12, and tongue element 48 of end cap 14 is adapted to be received in groove element 50 of end cap 20.

As best seen in FIGS. 1, 4, 5 and 7, an engaging element 66 extends from end wall 26 of end cap 14 for engaging end 16 of lighting fixture housing 22. Regarding end cap 20, engaging element 66 engages an end 18 of housing 24 of second lighting fixture 12. Engaging element 66 is preferably a flange 68 extending from end wall inner surface 36 along curved or lower edge 32. Flange 68 includes first and second curved ends 70 and 72 terminating at straight or upper edge 30 of end wall 26. Flange 68 is preferably substantially perpendicular to end wall 26 in cross-section.

The size and shape of flange 68 corresponds to the shape and size of the end 16 of fixture housing 22 to form an interference fit when the end cap 14 is coupled to the fixture end 16. In particular, flange 68 fits inside of fixture housing 22 at end 16 such that a friction fit is formed between an outer surface 74 of flange 68 and an inner surface 76 of housing end 16. Alternatively, flange 68 can be formed to fit on the outer surface 78 of housing end 16, thereby forming a friction fit between an inner surface 80 of flange 68 and outer surface 78 of housing end 16.

Although it is preferable that flange 68 be employed as the engagement element 66, other known engagement elements can be used instead, such as a tab and slot engagement, a fastener engagement, or an adhesive engagement. Also a secondary engagement mechanism can be employed to secure end cap 14 on fixture 10 and end cap 20 on fixture 12. For example, fasteners, such as screws, can be used with flange 68. Specifically, the curved ends 70 and 72 of flange 68 can include fastener holes 82 that correspond to and align with holes 84 in the fixture housing end 16, as seen in FIG. 1, when end cap 14 is mated with fixture 10 or housing end 18 when end cap 20 is mated with fixture 12. Fasteners 86 can then be inserted through holes 82 and 84 to further secure end caps 14 and 20 to fixture ends 16 and 18, respectively. Also, flange 68 can include a central tab 88 with a fastener hole 90 that corresponds to a hole 92 in fixture end 16 for end cap 14 and fixture end 18 for end cap 20. Another fastener 94 can then be inserted through holes 90 and 92.

As seen in FIGS. 2–7, end cap end wall 26 includes a suspension element 96 for facilitating suspension of the lighting fixtures. Suspension element 96 extends from the inner surface 36 of end wall 26 at upper or straight edge 30 in a direction opposite tongue element 48. Suspension element 96 is preferably a tab 98 with a slot 100 that is generally aligned and contiguous with first opening 38 of end wall 26. Tab 98 is substantially perpendicular to end wall 26 and extends toward the lighting fixture. First and second ears 102 extend from the sides of tab 98 to end wall inner surface 36, as seen in FIG. 2.

A support member 104, such as a cable, can be easily coupled with tab 98 and mounted to a support, such as a ceiling, for suspending the lighting fixtures 10 and 12. Although a cable is preferable, any known type of suspension mechanism can be used as support member 104. In particular, cable 104 includes an end 106 that is inserted through opening 38 in end wall 26 and rotated upwardly through slot 100 of tab 98, as seen in FIG. 1. An adjustment member 108, such as a nut, is coupled to end 106 of cable 104. Tab 98 rests on nut 108 with nut 108 abutting a lower surface 110 of tab 98, thereby suspending end cap 14 and end cap 20 and their respective lighting fixtures 10 and 12 from the ceiling. The location of nut 108 can vary with respect to cable 104, thereby allowing adjustment in the suspended distance of the lighting fixtures with respect to the ceiling. For example, the closer nut 108 is to the cable end 104, the greater the suspended distance between the lighting fixtures and the ceiling. Conversely, the further away the nut 108 is from cable end 104, the shorter the distance between the lighting fixtures and the ceiling.

A securing element 112 is used to secure cable 104 to tab 98. Securing element 112 is preferably a nut that is coupled to cable 104 above tab 98 so that nut 112 abuts the upper surface 114 of tab 98, thereby sandwiching tab 98 between upper nut 112 and lower nut 108, as seen in FIG. 7.

Assembly and Operation of Embodiment of FIGS. 1–7

Referring to FIGS. 1–7, assembly of lighting fixture 10 requires attaching the two end caps 14 to the respective ends 16 and 17 of the fixture housing 22. In particular, each end cap 14 is secured to each end 16 and 17 by inserting flange 68 into housing 22 until the end wall 26 of each end cap abuts the respective housing end 16, forming a friction fit with each end 16. Specifically, flange 68 is sized to form a tight fit with inner surface 76 of housing end 16. Alternatively, flange 68 can be shaped to fit outside of housing end 16 so that flange 68 forms a tight fit with the outer surface 78 of housing end 16.

Fasteners 86 and 94 can optionally be provided to further secure the two end caps 14 to their respective housing ends 16 and 17. In particular, fasteners 86 are inserted through holes 82 in the curves ends 70 and 72 of end caps 14 and through holes 84 of housing ends 16 and 17 which are aligned with holes 82 upon engagement of end caps 14 with the housing ends 16 and 17. Also, fasteners 94 are inserted through holes 90 in central tabs 88 of each end cap 14 and through 92 of each housing end 16 which are aligned with holes 90, respectively.

Figure 3:
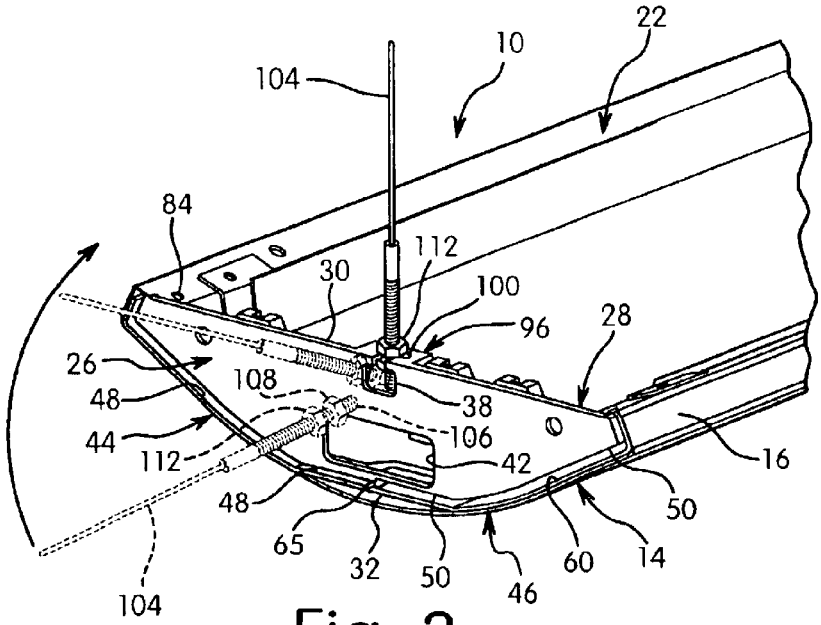
FIG. 3 is a partial perspective view of the lighting fixture illustrated in FIG. 1, showing the installation of a suspension mechanism with the end cap of the lighting fixture.

As seen in FIGS. 2 and 3, once each end cap 14 is secured to the housing ends 16 and 17, suspension element 96 or tab 98 of each end cap 14 extends inwardly toward fixture housing 22. A suspension mechanism can then be easily coupled with lighting fixture 10 at each end 16 and 17 via end caps 14. Specifically, support members or cables 104 are secured to tab 98 of each end cap 14. Adjustment element or nut 108 is threadably coupled to each cable 104 at a distance from their cable ends 106 corresponding to the desired height of lighting fixture 10. Securing elements or nuts 112 are also threadably coupled to each cable 104 above and spaced from nuts 108. With nuts 108 and 112 coupled to each cable 104, the cable ends 106 can then be inserted through openings 38 of their respective end cap end walls 26 and rotated through open end 40 of opening 38 and into slot 100 of tab 98. Lower surface 110 of each tab 98 rests on respective nuts 108 so that when cable 104 is attached to a support, such as a ceiling, lighting fixture 10 will suspend from cables 104 at each end cap 14. To secure each cable 104 to tabs 98, respectively, nut 112 is tightened so that tab 98 is tightly sandwiched between nut 108 and nut 112.

Figure 4:
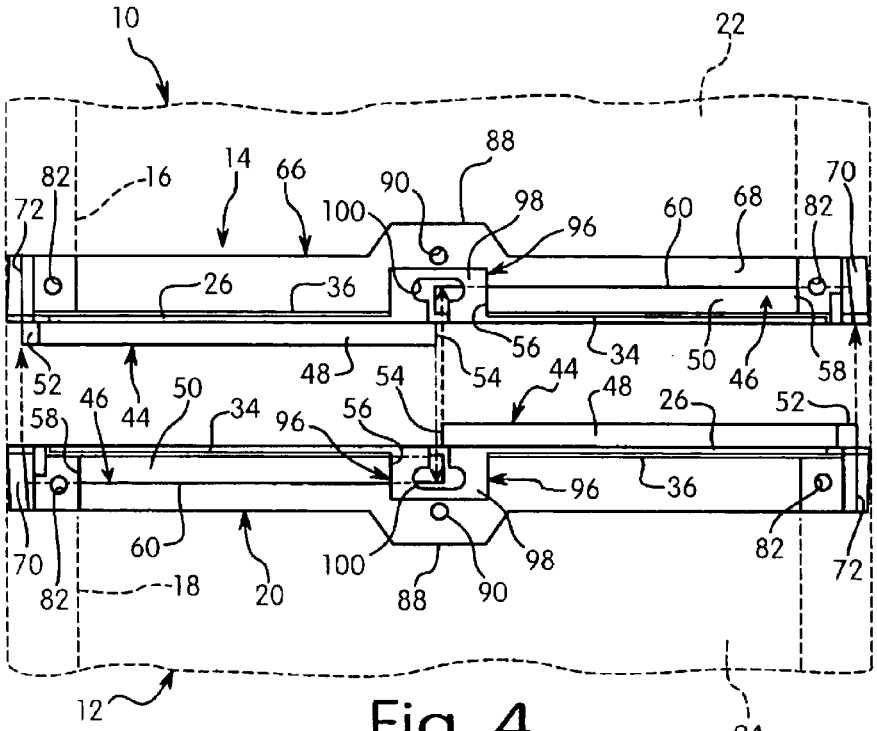
FIG. 4 is an exploded top plan view of the end caps of the lighting fixtures in accordance with the first embodiment of the present invention, showing the end caps and the lighting fixtures being connected end-to-end.
Figure 5:
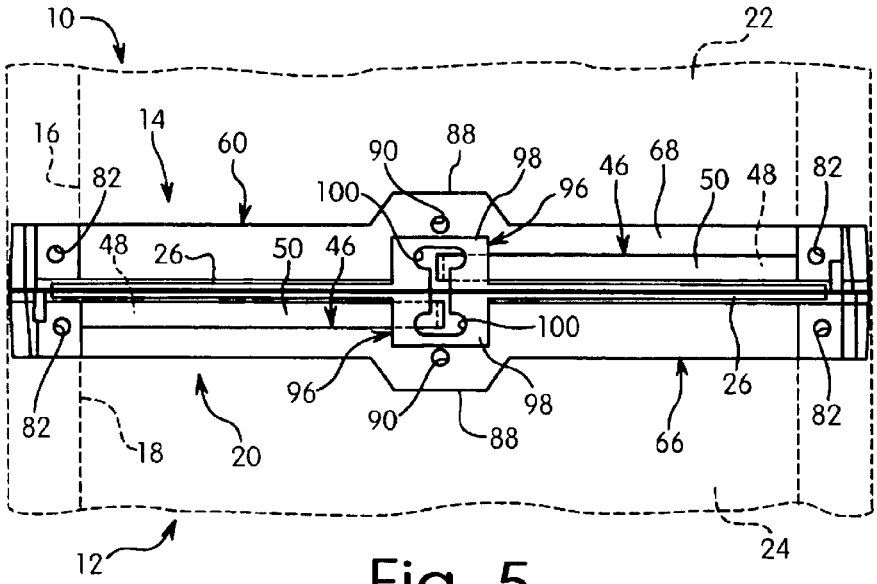
FIG. 5 is a top plan view similar to FIG. 4, showing the end caps of the lighting fixtures connected end-to-end.

As best seen in FIGS. 2, 4 and 5, tongue and groove elements 48 and 50 extend outwardly from each end cap end wall 26 away from fixture housing 22 for engagement with another lighting fixture 12. Lighting fixture 12 has end caps 20 (only one end cap 20 is shown in FIG. 2) that are substantially identical to end caps 14 and are secured to housing ends 18 of lighting fixture 12 in the same manner as described above with respect to end caps 14 and lighting fixture 10. End caps 14 and end caps 20 allow lighting fixtures 10 and 12 to be mated in an end-to-end arrangement while also substantially preventing light leakage at the mating point of the two fixtures.

Specifically, one end 16 of lighting fixture 10 is mated with one end 18 of lighting fixture 12 by engaging the tongue and groove elements 48 and 50 of the respective end caps 14 and 20 of fixtures 10 and 12, respectively. Tongue element 48 of end cap 14 fits into element groove 50 of end cap 20. Likewise groove element 50 of end cap 14 receives tongue element 50 of end cap 20. This tongue and groove mating of end caps 14 and 20 substantially prevents light leakage between end caps 14 and 20. Also, end caps 14 and 20 are substantially identical and mating due to the tongue and groove configurations, thereby simplifying manufacturing and reducing costs.

Embodiment of FIGS. 8–12

Figure 8:
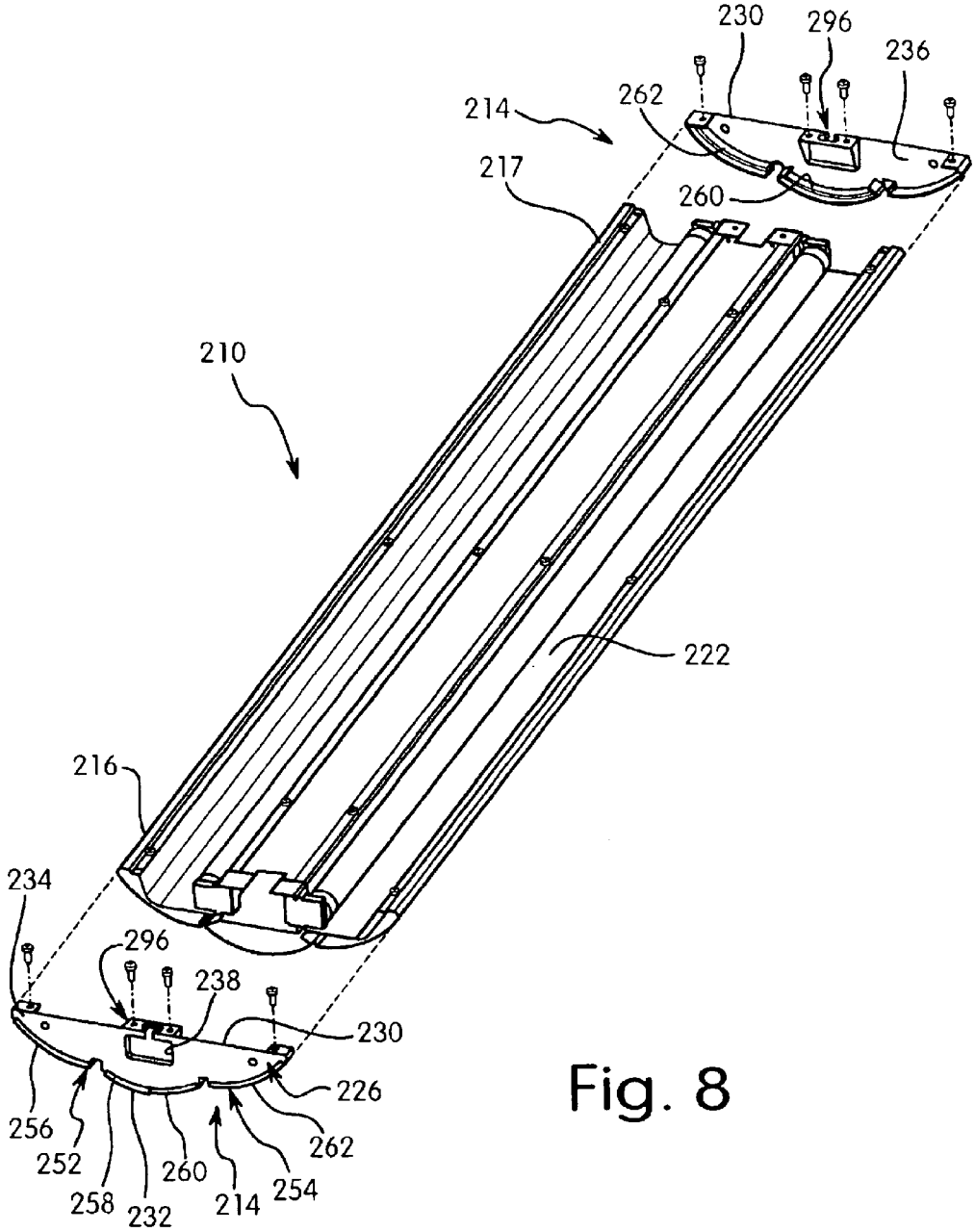
FIG. 8 is an exploded perspective view of a lighting fixture and end caps in accordance with a second embodiment of the present invention, showing the end caps being assembled with the lighting fixture.
Figure 9:
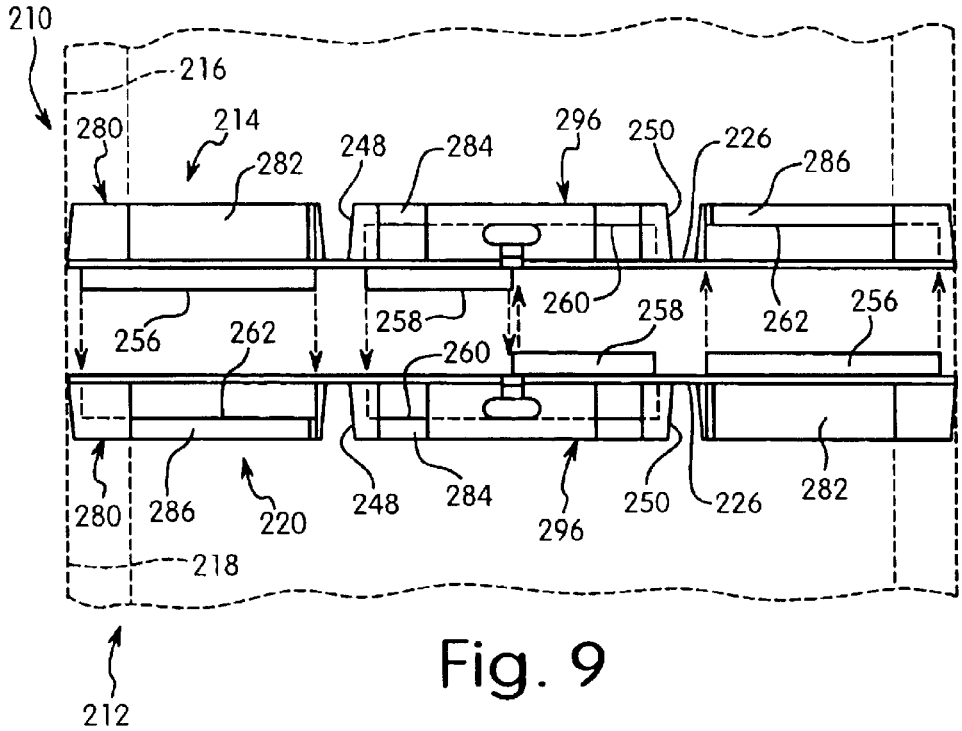
FIG. 9 is an exploded top plan view of first and second lighting fixtures in accordance with the second embodiment of the present invention, showing the end caps of the lighting fixtures being connected end-to-end.
Figure 10:
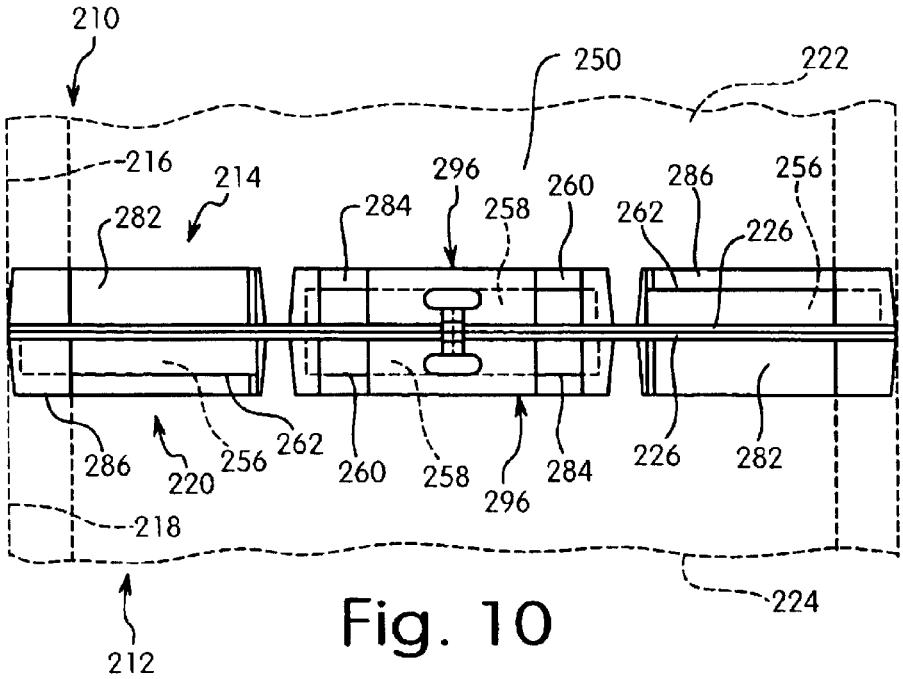
FIG. 10 is a top plan view similar to FIG. 9 showing the end caps and the lighting fixtures assembled end-to-end.

Referring to FIGS. 8–12, a lighting fixture 210 in accordance with a second embodiment of the present invention includes two end caps 214 at opposing ends 216 and 217 of fixture 210. End caps 214 allow connection of lighting fixture 210 to another similar lighting fixture 212 in an end-to-end arrangement, as seen in FIGS. 9 and 10, in the same manner as described above with respect to the first embodiment. Like the first embodiment, end cap 214 at first end 216 of fixture 210 engages an end cap 220 of fixture 212 for an end-to-end connection of the two fixtures. End cap 214 of fixture 210 and end cap 220 of fixture 212 are substantially identical, thereby reducing manufacturing costs and simplifying connection of the two fixtures. Also, the configurations of end caps 214 and 220 substantially prevent leakage of light at the connection point of fixtures 210 and 212.

Figure 11:
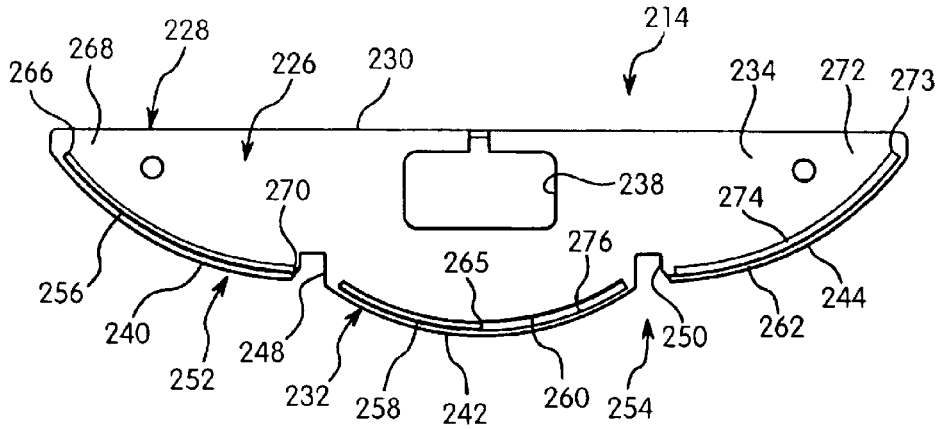
FIG. 11 is a side elevational view of the end cap illustrated in FIG. 8.
Figure 12:
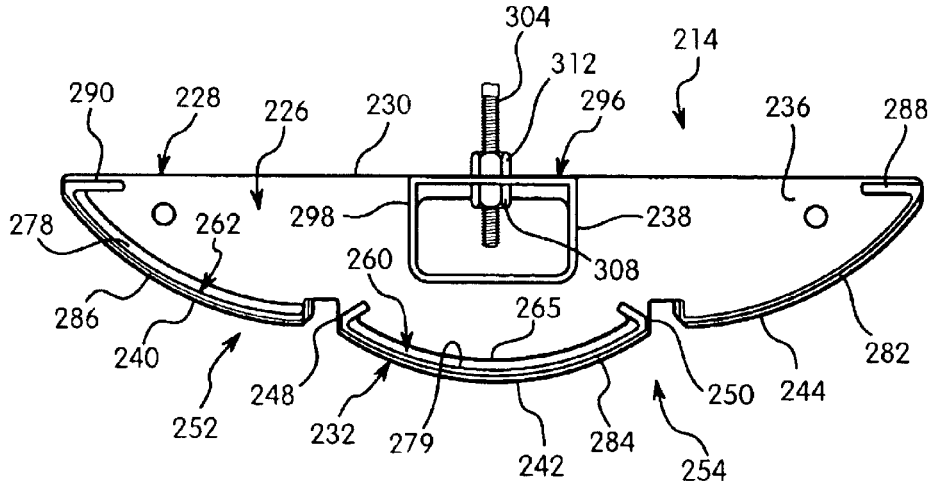
FIG. 12 is a side elevational view of the end cap illustrated in FIG. 8, showing the suspension mechanism coupled thereto.

End caps 214 and 220 engage the ends 216 and 217 of housings 222 and ends 218 (only one end shown) of housing 224 of lighting fixtures 210 and 212, respectively. Since end caps 214 and 220 are substantially identical, only end cap 214 will be described and the description of end cap 214 applies to end cap 220. Also, end caps 214 engage fixture ends 216 and 217 in the same manner and thus only the engagement with fixture end 216 with be described. End cap 214 includes an end wall 226 having a generally semi-circular shape. However, end wall 226 can have any desired shape, such as any polygonal shape or circular shape. A periphery 228 of end wall 226 defines the outer border of end wall 226 and includes an upper edge 230 that is substantially straight and a lower edge 232 that includes three substantially curved segments 240, 242, and 244 formed by first and second gaps 248 and 250 in curved edge 232, as best seen in FIGS. 11 and 12. Segment 242 is located between segments 240 and 244. A first or outer surface 234 of end wall 226 faces outwardly away from lighting fixture housing 222, as seen in FIG. 8. A second or inner surface 236 is opposite outer surface 234 and faces toward light fixture housing 222. End wall 226 includes a first opening 238 similar to that of first opening 38 in end wall 26 of the first embodiment except first opening 238 both receives a suspension mechanism (not shown) in the same manner as described with respect to the first embodiment and provides access to the ballastry of the fixture.

End cap 214 includes engagement elements 252 and 254 similar to engagement elements 44 and 46 of the first embodiment except engagement elements 252 and 254 include multiple tongue elements 256 and 258 and multiple groove elements 260 and 262 instead of just one continuous tongue element 48 and one continuos groove element 50 as in the first embodiment. Like tongue and groove elements 48 and 50 of the first embodiment, each of the tongue elements 256 and 258 and groove elements 260 and 262 extend from end wall outer surface 234 and along curved edge 232. First tongue element 256 extends along first substantially curved segment 240 and second tongue element 258, which is shorter in length than tongue element 256, extends along about half of second substantially curved segment 242, with first gap 248 being disposed therebetween. First groove element 260 extends along half of second substantially curved segment 242 and second groove element 262, which is longer in length than groove element 260, extends along third segment 244 with second gap 250 being disposed therebetween. First groove 260 meets second tongue element 258 at a mid-point 265 of second segment 242. As with the first embodiment, although tongue and groove elements are preferable, any type of known engagement mechanism can be employed, such as, snapping or latching elements, fastener elements, or adhesive elements.

As seen in FIGS. 11 and 12, a first end 266 of first tongue element 256 meets substantially straight edge 230 at one side 268 of end wall 226 and a second end 270 terminates at first gap 248 of curved edge 232. First groove element 260 meets the opposite side 272 of straight edge 230 at one end 273 and terminates at second gap 250.

First and second groove elements 260 and 262 define access openings 276 and 274 that open at the outer surface 234 of end wall 226, as seen in FIG. 11. Each groove element 260 and 262 includes a main body 279 and 278 that extends away from the inner surface 236 of end wall 226, as best seen in FIG. 12, in a generally perpendicular orientation with respect to end wall 226 in cross section.

As best seen in FIGS. 8, 9 and 12, end cap 214 includes an engaging element 280 for securing end cap 214 to fixture 210 that is similar to engaging element 66 of end cap 14 of the first embodiment except that engaging element 280 includes multiple flanges 282, 284 and 286 instead of just a single flange 68 of the first embodiment. Each flange 282, 284 and 286 extends from inner surface 236 of end wall 226 in a direction opposite engaging elements 252 and 254. First flange 282 extends along first segment 240 of curved edge 232, second flange extends along second segment 242 and third flange 286 extends along third segment 244. First flange 282 includes a first curved end 288 terminating at straight or upper edge 230 of end wall 226 and third flange 286 includes a second curved end 290 opposite first curved end 288 and terminating at edge 230. Curved ends 288 and 290 are similar to curved ends 270 and 272 of end cap 14 of first embodiment.

Flanges 282, 284, and 286 are sized and shaped in the same manner as flange 68 of the first embodiment to form an interference fit when the end cap 214 is coupled to the fixture end. Although it is preferable that flanges 282, 284 and 288 be employed to couple end cap 214 to fixture 210, other known engagement elements can be used instead, such as a tab and slot engagement, a fastener engagement, or an adhesive engagement. Also, a secondary engagement mechanism, such as fasteners, can be employed to secure end cap 214 on fixture 210 in the same manner as described with respect to the first embodiment.

As seen in FIG. 12, a suspension element 296 for facilitating suspension of the lighting fixture 210 is substantially identical to suspension element 96 of the first embodiment and thus will not be described in detail. As with suspension element 96 of the first embodiment, suspension element 296 includes a tab 298 that engages a cable 304, an adjustment element or nut 308, and a securing element or nut 312 in the same manner as described above with respect to tab 98 of the first embodiment.

Assembly and Operation of Embodiment of FIGS. 8–12

Referring to FIGS. 8–12, end caps 214 are assembled with lighting fixture 210 in the same manner as described with respect to end caps 14 and fixture 10 of the first embodiment. Once each of the end caps 214 are secured to the housing ends 216, the suspension mechanism including cable 304 and nuts 308 and 312 can then be easily coupled with lighting fixture 210 at ends 216 and 217 via end caps 214 and tab 298.

As seen in FIGS. 9 and 10, tongue elements 256 and 258 and groove elements 260 and 262 extend outwardly from each end cap end wall 226 away from fixture housing 222 for engagement with another lighting fixture 212 in the same manner as describe with respect to the first embodiment. Lighting fixture 212 has end caps 220 (only one end cap 220 is shown in FIGS. 9 and 10) that are substantially identical to end caps 214 and are secured to housing ends 218 of lighting fixture 212 in the same manner as end caps 214 and lighting fixture 210, allowing an end-to end mating of the fixtures.

Specifically, one end 216 of lighting fixture 210 is mated with one end 218 of lighting fixture 212 by engaging first and second tongue elements 256 and 258 of end cap 214 with groove elements 262 and 260 of end cap 220. Likewise, first and second groove elements 260 and 262 of end cap 214 engage tongue elements 258 and 256 of end cap 220.

While particular embodiments have been chosen to illustrate the invention, it will be understood by those skilled in the art that various changes and modifications can be made therein without departing from the scope of the invention as defined in the appended claims.

What is claimed is:

1. An end cap for a lighting fixture, comprising:

an end wall having a periphery, an outer surface, and an inner surface opposite said outer surface and adapted to engage the lighting fixture;

a tongue element extending from said outer surface in a first direction along said periphery of said end wall;

a groove element disposed along said periphery of said end wall, said groove element being open at said outer surface of said end wall; and a suspension element extending from said inner surface at said periphery of said end wall, said suspension element extending in a second direction opposite said first direction of said tongue element.

2. An end cap according to claim 1, wherein said tongue element and said groove element are disposed end-to-end along said periphery of said end wall.

3. An end cap according to claim 1, wherein said periphery of said end wall includes a substantially straight edge and a substantially curved edge; and each of said tongue and groove elements, respectively, extends along said substantially curved edge, and said suspension element extends from said substantially straight edge.

4. An end cap according to claim 3, wherein said tongue element extends along a first half of said substantially curved edge, and said groove element extends along a second half of said substantially curved edge; and said suspension element is centrally disposed on said substantially straight edge.

5. An end cap according to claim 1, wherein an engaging member extends along said periphery of said end wall in said second direction for engaging the lighting fixture.

6. An end cap according to claim 5, wherein said engaging member includes a flange adapted to engage the lighting fixture by an interference fit.

7. An end cap according to claim 1, wherein each of said tongue and groove elements, respectively, is a single continuous element.

8. An end cap according to claim 1, wherein a plurality of tongue elements and a plurality of groove elements extend along said periphery of said end wall.

9. An end cap according to claim 1, wherein each of said end wall, tongue element, groove element and suspension element form a unitary one-piece member.

10. An end cap according to claim 1, wherein each of said tongue and groove elements and said suspension element, respectively, are substantially perpendicular to said end wall in cross section.

11. An end cap for a lighting fixture, comprising:

an end wall having a periphery, an outer surface, an inner surface opposite said outer surface and adapted to engage the lighting fixture, and an opening at said periphery;

first and second engagement elements extending from said outer surface along said periphery of said end wall; and a suspension element extending from said inner surface at said periphery of said end wall, said suspension element including a tab extending substantially perpendicularly from said end wall, said tab having a slot contiguous with said opening in said end wall, each of said slot of said tab and said opening of said end wall, respectively, being adapted to receive a support member for suspending the lighting fixture.

12. An end cap according to claim 11, wherein said tab includes first and second opposite surfaces; and said support member includes an adjustment element disposed adjacent said second surface of said tab for adjusting the suspending position of the lighting fixture.

13. An end cap according to claim 12, wherein said adjustment element is a first nut coupled to said support member.

14. An end cap according to claim 12, wherein said support member includes a securing element disposed adjacent to said first surface of said tab so that said tab is secured between said securing element and said adjustment element, thereby securing said support member to said tab.

15. An end cap according to claim 14, wherein said securing element is a second nut coupled to said support member.

16. An end cap according to claim 15, wherein said support member is a cable.

17. An end cap according to claim 11, wherein said tab extends from a substantially straight edge of said periphery remote from said first and second engagement elements.

18. An end cap according to claim 17, wherein said first and second engagement elements are tongue and groove elements, respectively.

19. A lighting fixture assembly, comprising:

first and second lighting fixtures, each of said lighting fixtures, respectively, having an end; and first and second substantially identical end caps coupled to said ends of each of said first and second lighting fixtures, respectively, each of said first and second end caps having an end wall with first and second opposite surfaces, and tongue and groove elements extending from said first and second surfaces, respectfully, said tongue element of said first end cap being substantially enclosed in said groove element of said second end cap and said tongue element of said second end cap being substantially enclosed in said groove element of said first end cap, so that there is substantially no space between any portions of said first and second end caps.

20. A lighting fixture assembly according to claim 19, wherein each of said first and second end caps is formed as a unitary one-piece member.

21. A lighting fixture assembly according to claim 19, wherein each of said end caps includes a second tongue element and a second groove element.

22. A lighting fixture assembly, comprising:

a lighting fixture having opposing ends; and an end cap coupled to one of said ends of said lighting fixture, said end cap having an end wall with a periphery and opposite outer and inner surfaces, a tongue element extending from said periphery of said end wall, a groove element disposed along said periphery of said end wall, said groove element being open at said outer surface of said end wall, and an engaging member extending from said periphery of said end wall at said inner surface, said engaging member being adapted to form an interference fit with said one end of said lighting fixture.

23. A lighting fixture assembly according to claim 22, wherein said engaging member is a flange that is substantially perpendicular to said end wall in cross-section.

24. A lighting fixture assembly according to claim 23, wherein said flange extends in a direction opposite that of said tongue element.

25. A lighting fixture assembly according to claim 22, wherein said end cap is formed as a unitary one-piece member.

26. A lighting fixture assembly according to claim 22, wherein said end cap includes a second tongue element and a second groove element extending from said end wall.

* * * * *